US009254032B2

(12) United States Patent
Moreau et al.

(10) Patent No.: US 9,254,032 B2
(45) Date of Patent: Feb. 9, 2016

(54) DROP-PREVENTION POUCH FOR CORDLESS POWER TOOLS

(71) Applicant: Ty-Flot, Inc., Manchester, NH (US)

(72) Inventors: Darrell A. Moreau, Manchester, NH (US); Andre W. Moreau, Spring Hill, FL (US)

(73) Assignee: Ty-Flot, Inc., Manchester, NH (US)

( * ) Notice: Subject to any disclaimer, the term of this patent is extended or adjusted under 35 U.S.C. 154(b) by 0 days.

(21) Appl. No.: 14/496,598

(22) Filed: Sep. 25, 2014

(65) Prior Publication Data

US 2015/0090749 A1 Apr. 2, 2015

Related U.S. Application Data

(63) Continuation-in-part of application No. 29/471,853, filed on Nov. 6, 2013, now Pat. No. Des. 732,825.

(60) Provisional application No. 61/883,363, filed on Sep. 27, 2013.

(51) Int. Cl.
*A45F 5/00* (2006.01)

(52) U.S. Cl.
CPC ..... *A45F 5/00* (2013.01); *A45F 2005/008* (2013.01); *A45F 2200/0575* (2013.01)

(58) Field of Classification Search
CPC ..... A45F 2200/0275; A45F 2200/0575; A45F 5/00; A45F 2005/006; A45F 2005/008
USPC ..... 224/904, 254, 235, 191
See application file for complete search history.

(56) References Cited

U.S. PATENT DOCUMENTS 1,681,922 A * 8/1928 Boch ..... A45C 3/00 206/574
4,773,535 A 9/1988 Cook
4,986,554 A * 1/1991 Rathbun ..... B23B 45/006 24/300

(Continued)

FOREIGN PATENT DOCUMENTS

CH 244216 A 8/1946
GB 2443639 A 5/2008

(Continued)

OTHER PUBLICATIONS

Tool Arrest, Tool@rrest power tool wrap with H/D tether, available at http://www.toolarrest.co.uk/power-tool-wrap (viewed Sep. 12, 2013).

(Continued)

*Primary Examiner* — Corey Skurdal
(74) *Attorney, Agent, or Firm* — Mesmer & Deleault PLLC

(57) ABSTRACT

A drop-prevention pouch for a cordless power tool has a battery pack that defines a battery pack perimeter. The drop-prevention pouch includes a pouch floor and a pouch sidewall extending transversely from the pouch floor and having a sidewall rim portion defining a pouch opening. The pouch floor and the pouch sidewall define a chamber sized to receive the battery pack when the battery back is attached to the cordless power tool. A flexible conduit extends along the sidewall rim portion. A drawstring extends through the flexible conduit and is capable of restricting the pouch opening to be smaller than the battery pack perimeter, thereby preventing the drop-prevention pouch from being removed from the battery pack when the battery pack is attached to the cordless power tool.

9 Claims, 12 Drawing Sheets

(56) References Cited

U.S. PATENT DOCUMENTS

| | | | | | |
|---|---|---|---|---|---|
| 5,002,401 | A * | 3/1991 | Blackman | A45C 7/0095 | 150/112 |
| D333,215 | S | 2/1993 | Brown | | |
| 5,394,592 | A * | 3/1995 | Quick | B25F 5/00 | 24/16 R |
| 5,653,337 | A * | 8/1997 | Cirigliano | A45C 3/00 | 206/373 |
| 5,692,660 | A * | 12/1997 | Stewart | A45C 3/00 | 190/103 |
| 5,711,055 | A * | 1/1998 | Quick | B25B 5/00 | 24/129 R |
| 6,065,658 | A * | 5/2000 | Hashimoto | A45F 3/14 | 224/254 |
| 6,209,723 | B1 * | 4/2001 | Fields | A45C 7/0095 | 190/109 |
| 6,315,179 | B1 * | 11/2001 | Hillis | A45F 3/14 | 224/200 |
| 6,561,402 | B2 * | 5/2003 | Holland | A45F 5/00 | 224/192 |
| D549,956 | S * | 9/2007 | Jones | D3/218 | |
| 7,489,111 | B2 * | 2/2009 | Wise | A45F 5/021 | 224/223 |
| 7,629,766 | B2 * | 12/2009 | Sadow | H02J 7/0044 | 173/217 |
| 7,658,307 | B2 * | 2/2010 | Skupin | A45F 5/004 | 224/219 |
| D615,757 | S * | 5/2010 | Kostner | D3/244 | |
| D655,504 | S * | 3/2012 | Barlier | D3/303 | |
| D691,797 | S * | 10/2013 | Little | D3/232 | |
| D715,549 | S * | 10/2014 | Moreau | D3/303 | |
| D731,175 | S * | 6/2015 | Moreau | D3/232 | |
| D732,825 | S * | 6/2015 | Moreau | D3/303 | |
| 2003/0173391 | A1 | 9/2003 | Girbert | | |
| 2005/0258203 | A1 * | 11/2005 | Weaver | A45F 5/021 | 224/162 |
| 2009/0242598 | A1 * | 10/2009 | Dormaar | A45F 3/14 | 224/257 |
| 2013/0047561 | A1 | 2/2013 | Nichols, Jr. | | |
| 2013/0048691 | A1 * | 2/2013 | Meyer | A45F 3/12 | 224/579 |
| 2013/0192450 | A1 | 8/2013 | Lalor | | |

FOREIGN PATENT DOCUMENTS

| | | | |
|---|---|---|---|
| JP | 5002079 | B1 | 8/2012 |
| WO | 2008100890 | A3 | 8/2008 |

OTHER PUBLICATIONS

Viper Tool, Leading Edge strap with D-ring or cinchable line, available at http://toollanyardsbagsandbelts.com/viper-tool-safety-range.html#axzz2ehfbOhLs (viewed Sep. 12, 2013).

Topo Designs, Cinch Bag by Topo Designs, available at http://topodesigns.com/collection/cinch-bag/ (viewed Sep. 9, 2013).

Baldwinsville, Baldwinsville water rescue throw bag with cinch closure, available at http://gloveholders.com/Baldwinsville%20Water%20Rescue%20Throw%20Bag.htm (viewed Sep. 12, 2013).

Martin, Martin Camera Lens Bag Soft Carrying Case Drawstring Pouch-Small, available at http://www.buysku.com/wholesale/camera-lens-bag-soft-carrying-case-drawstring-pouch-small.html (last visited Sep. 12, 2013).

alibaba.com, drawstring clasp cooler bag for beverage container, available at http://www.alibaba.com/product-gs/424314924/Pull_clasp_cooler_bag_drawstring_cooler.html (viewed Sep. 12, 2013).

European Patent Office, International Search Report and Written Opinion, PCT Application US2014/057451 (Feb. 11, 2015).

* cited by examiner

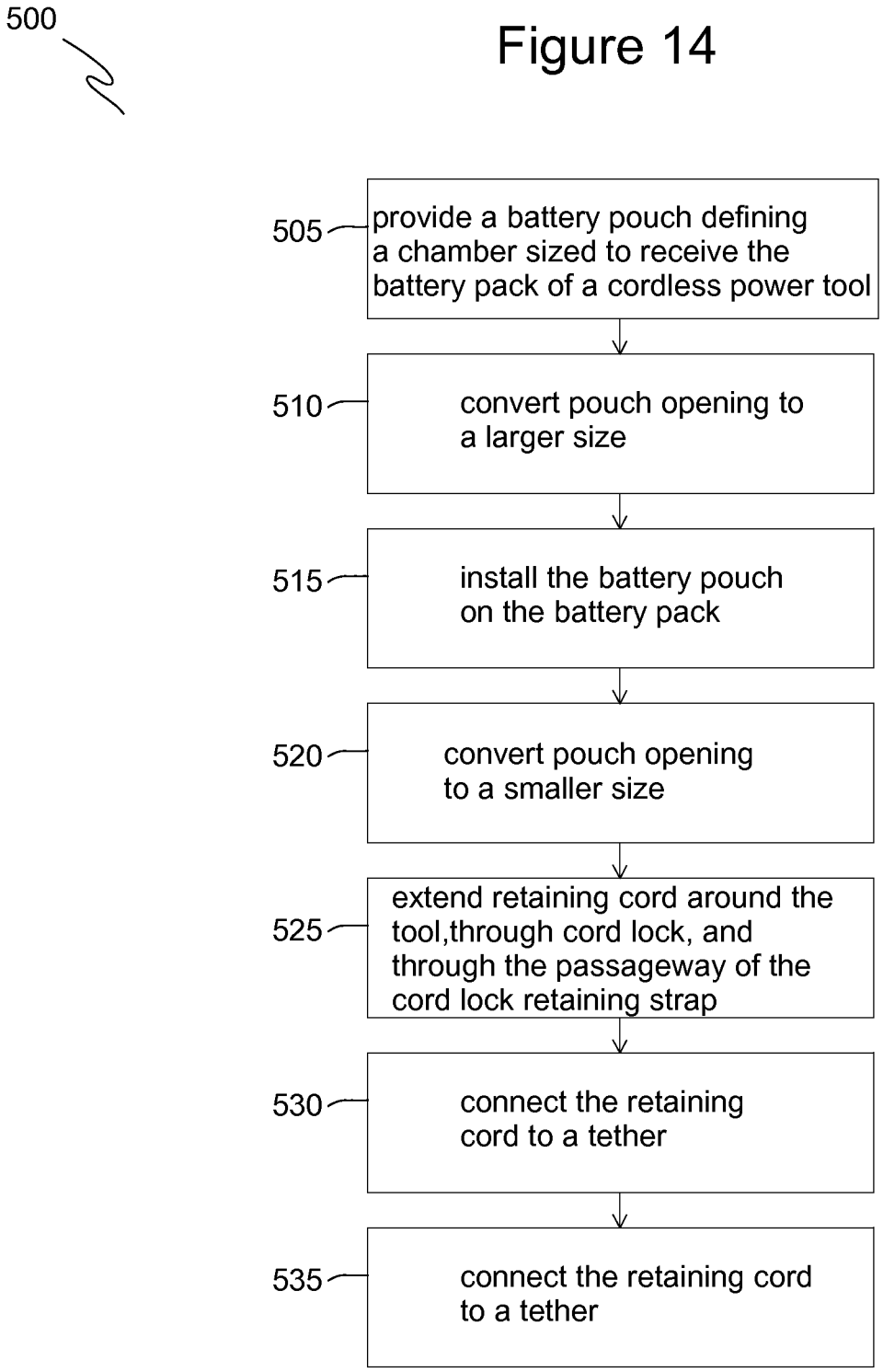
500
Figure 14
505
provide a battery pouch defining a chamber sized to receive the battery pack of a cordless power tool
510
convert pouch opening to a larger size
515
install the battery pouch on the battery pack
520
convert pouch opening to a smaller size
525
extend retaining cord around the tool,through cord lock, and through the passageway of the cord lock retaining strap
530
connect the retaining cord to a tether
535
connect the retaining cord to a tether

DROP-PREVENTION POUCH FOR CORDLESS POWER TOOLS

BACKGROUND OF THE INVENTION

1. Field of the Invention

The present invention relates generally to tool accessories and more particularly to a drop-prevention apparatus for hand-held power tools.

2. Description of the Prior Art

Lanyards, tethers, hooks, and similar restraints are used to prevent accidental dropping of tools. These restraints are particularly useful in environments where a tool drop can cause substantial damage or harm to plant equipment, workers, or objects below a worker who accidentally drops a tool.

One method of restraining tools is to clip one end of a tether to an opening in the handle of a tool (e.g., an adjustable wrench) and to clip the other end of the tether to the worker's belt or to a nearby structure. When workers properly tether a tool in this way, accidental drops can be eliminated or greatly reduced. However, due to safety concerns and to practical design limitations, hand-held power tools are generally not specifically designed to be tethered. For example, the moving parts on rotary saws and drills potentially could get tangled with the tether, causing injury to a worker or severing the tether when the tool is dropped. Also, when compared to hand-held tools, the larger size of battery-powered power tools provides options for tethering that are not available with hand-held tools. For example, to tether a power tool, the user may tether the battery-powered power tool, such as by attaching a tether to an opening in the tool's frame, wrapping the tether around a handle, or other improvised approach. Cordless drills are an example of one power tool that lacks an opening to which a tether could be attached.

In one approach to the problem of tethering a cordless drill, a cord loops around the handle of the drill in a slip-knot fashion or the like. After looping around the handle, the cord is attached to a tether that in turn is attached to the user's wrist or to another object. To prevent the cord from slipping off of the end of the drill's handle, this approach relies on the difference in size between the main part of the handle and the battery pack or butt of the handle, which is generally larger in size than the main part of the handle.

Another approach to the problem of tethering a cordless drill is a tool wrap that has a cover formed with large straps and a connector ring. The cover is shaped to loosely slip over the block-shaped battery pack and then is secured to the battery pack by tightening the straps around the battery pack. A first strap connected at one end to the cover extends over the top of the battery pack in front of the handle and attaches to itself or to the cover using hook-and-loop fasteners. A second strap connects at one end to the front end or "toe" of the cover and wraps horizontally along the side of the battery pack, around the "heel" of the battery pack, and along the opposite side of the battery pack where it connects with hook-and-loop fasteners to itself or to the cover. The second strap passes through and retains a connector ring near the "heel" of the battery pack. A tether may be connected to the connector ring.

SUMMARY OF THE INVENTION

Unfortunately, the above-described tethering approaches have deficiencies for use with cordless, battery-powered power tools. Cords wrapped around the handle of the drill tend to get in the user's way and are uncomfortable because the user's hand often rests on the cord. This problem is compounded by the need for a cord thick enough and strong enough to prevent the fall of a dropped power tool. Also, to secure the cord tightly to the handle, a cord lock, connector, or knot is required. The cord lock, connector, or knot located at the handle is an additional item that interferes with the user's comfort and use of the drill, especially during extended use.

Another problem with cordless, battery-powered hand tools is that the battery pack can become loose and separate from the cordless, battery-powered hand tool if the battery is inadvertently bumped. Due to its typical size and weight, a falling battery pack may cause damage to equipment or serious injury to persons in the path of a falling battery pack. A cord wrapped around the tool's handle does not prevent the battery pack from falling when it is inadvertently knocked loose from a cordless power tool.

Battery pouches with straps tend to be bulky and expensive to manufacture. Also, loose ends of the straps are prone to catching on the user's clothing, work area, or moving parts of power tools.

Therefore, an alternative approach to tethering power tools described above is needed for battery-powered tools, such as drills, saws, grinders, caulking guns, work lights, and other battery-powered tools. What is needed is a drop prevention pouch for cordless power tools that solves the problems mentioned above.

It is an object of the present invention to provide a removable drop-prevention pouch for battery-powered cordless power tools.

It is further an object of the present invention to provide a drop-prevention pouch that fits over the battery pack to reliably retain the battery pack with the battery-powered tool when the tool is dropped or in the event the battery pack is separated from the tool.

The present invention achieves these and other objectives by providing a drop-prevention pouch for a cordless power tool having a battery pack defining a battery pack perimeter. In one embodiment, the drop-prevention pouch includes a pouch floor or bottom portion and a sidewall extending transversely from the pouch floor. A rim or top sidewall portion defines a pouch opening with a pouch opening perimeter. The pouch floor and the pouch sidewall define a chamber sized to snugly receive the battery pack when the battery back is attached to the cordless power tool. A flexible conduit extends along the top sidewall portion. A drawstring extends through the flexible conduit and is capable of restricting the pouch opening perimeter to be smaller than the battery pack perimeter, thereby preventing the drop-prevention pouch from being removed from the battery pack when the battery pack is attached to the cordless power tool.

In another embodiment, the drawstring is stretchable, thereby being convertible between a relaxed state and a stretched state. In one embodiment, the drawstring defines a closed loop. In its relaxed state, the stretchable drawstring restricts the pouch opening perimeter to be smaller than the battery back perimeter. In the stretched state, the stretchable drawstring permits the pouch opening perimeter to be sufficient for the battery pack to pass through the pouch opening.

In another embodiment, the battery pouch includes a cord lock installed on a non-enclosed portion of the drawstring. In one embodiment, the non-enclosed portion is an outside portion of the drawstring that extends from a conduit opening in the conduit. In another embodiment, the non-enclosed portion is part of an alternate drawstring that extends through the chamber and around the outside of part of the battery pouch.

In another embodiment, the battery pouch includes a cord lock strap fixedly connected to an outside surface of the pouch and defining a passageway between the cord lock strap and the outside surface of the pouch. When the cord lock is positioned between the cord lock strap and the conduit opening or pouch opening, the cord lock strap is constructed and arranged to prevent the cord lock from passing through the passageway when the non-enclosed portion of the drawstring is pulled through the passageway in a direction away from the conduit opening, thereby causing the flexible drawstring to pass through the cord lock and further restrict the pouch opening perimeter.

In another embodiment, the battery pouch includes a tether connector connected to the non-enclosed portion of the drawstring.

In another embodiment, the battery pouch includes an retaining cord having a foot portion that extends over a foot of the cordless power tool when the pouch is installed on a battery pack connected to the cordless power tool. Here, a first retaining cord portion extends from the foot portion into the cavity and through a first sidewall portion to outside the chamber, and a second retaining cord portion extending from the foot portion into the cavity and through a second sidewall portion opposite the first sidewall portion to outside the chamber. The first retaining cord portion and the second retaining cord portion are joined together outside the chamber.

In another embodiment, a cord lock is installed on the retaining cord and brings together or connects the first retaining cord portion to the second retaining cord portion.

In another embodiment, the battery pouch includes a pouch retaining strap constructed and arranged to extend from a first sidewall portion to a second sidewall portion with the pouch retaining strap extending over a foot of the cordless power tool. In one embodiment, the pouch retaining strap is configured to releasably connect to at least one of the first sidewall portion and the second sidewall portion.

In another embodiment, a drop-prevention pouch includes a pouch floor and a pouch sidewall extending transversely from the pouch floor and having an elasticized rim portion defining a pouch opening. The pouch floor and the pouch sidewall define a chamber sized to receive the battery pack when the battery back is attached to the cordless power tool where the pouch floor and the pouch sidewall are adjacent the battery pack. A cord lock strap is fixedly connected to an outside surface of the pouch and defines a passageway between the cord lock strap and the outside surface of the pouch. A retaining cord having a foot portion is constructed to extend over a foot of the cordless power tool when the pouch is installed on a battery pack connected to the cordless power tool. A first retaining cord portion extends from the foot portion into the cavity and through a first sidewall portion to outside the chamber. A second retaining cord portion extends from the foot portion into the cavity and through a second sidewall portion opposite the first sidewall portion to outside the chamber. A cord lock is installed on the retaining cord outside of the chamber and brings together or connects the first retaining cord portion and the second retaining cord portion. When the cord lock is positioned between the cord lock strap and the conduit opening, the cord lock strap is constructed and arranged to prevent the cord lock from passing through the passageway when the first retaining cord portion and the second retaining cord portion are pulled through the passageway in a direction away from the conduit opening, thereby urging the retaining cord to tighten around the foot portion of the cordless power tool.

Another aspect of the present invention includes a method of tethering a power tool having a battery pack. In one embodiment, the method includes providing a battery pack pouch that defines a compartment sized to receive the battery back of a cordless power tool. The battery pack pouch has a pouch opening convertible between a smaller opening size and a larger opening size, a retaining cord with a cord lock, and a cord lock retaining strap secured to a sidewall of the battery pack pouch. The method also includes the steps of converting the pouch opening to the larger opening size, installing the battery pack pouch over the battery pack of the cordless power tool with a portion of the cordless power tool extending through the pouch opening, converting the pouch opening to the smaller opening size thereby retaining the battery pack in the compartment, extending a first portion of the retaining cord around the portion of the cordless power tool that extends through the elasticized pouch opening, extending a second portion of the retaining cord through a passageway defined by the cord lock retaining strap wherein the cord lock remains between the cord lock retaining strap and the elasticized pouch opening, tightening the retaining cord against the portion of the cordless power tool extending through the elasticized pouch opening, and connecting the retaining cord to a tether.

In another embodiment of the method, the providing step includes selecting a battery pack pouch having a flexible conduit extending along a major portion of the pouch opening. In another embodiment, the providing step further includes selecting the battery pack pouch with the drawstring extending through the flexible conduit. In another embodiment, the providing step further includes selecting the battery pack pouch wherein the drawstring is elasticized.

In another embodiment of the method, the providing step includes selecting the battery pack pouch with a retaining cord extending through a first sidewall opening and through a second sidewall opening in a sidewall of the battery pack pouch, where the retaining cord extends through the first sidewall opening, across the portion of the cordless power tool, and through the second sidewall opening.

In another embodiment of the method, the providing step includes selecting the battery pack pouch with an elasticized pouch opening, where the step of converting the pouch opening to the larger opening size includes stretching the elasticized opening and the step of converting the pouch opening to the smaller opening size includes permitting the elasticized opening to at least partially resume a relaxed state.

BRIEF DESCRIPTION OF THE DRAWINGS

FIG. 14 is a flow chart illustrating exemplary steps of one embodiment of a method of tethering a power tool.

DETAILED DESCRIPTION OF THE PREFERRED EMBODIMENT

The preferred embodiments of the present invention are illustrated in FIGS. 1-14. As used herein, the terms "up," "down" and related terms refer to the orientation of a battery pouch 10 with a bottom portion or floor 22 resting on a level, horizontal surface. Battery pouch 10 is intended to be used in any orientation.

Figure 1:
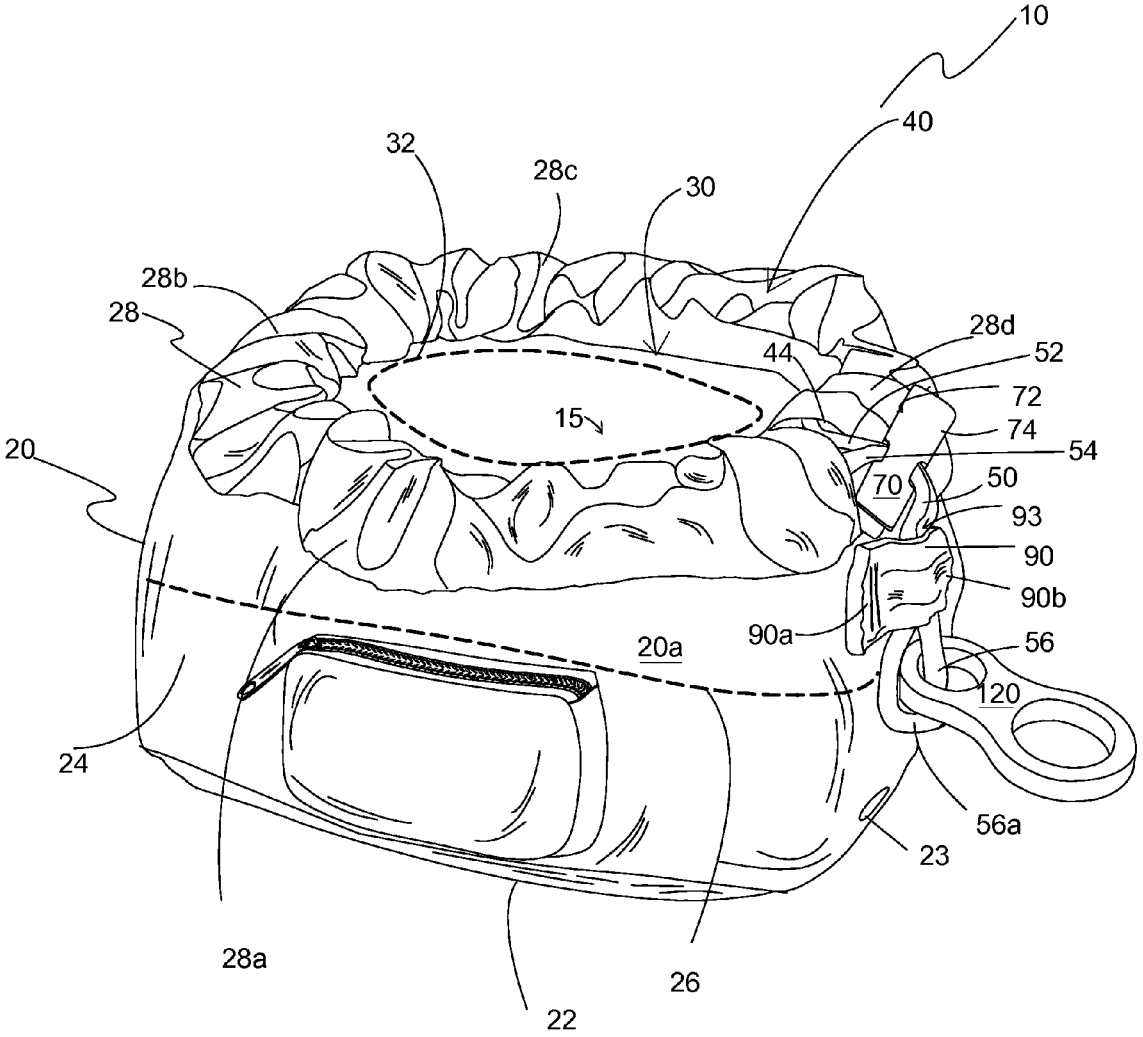
FIG. 1 is a rear, top, and left-side perspective illustration of one embodiment of the present invention showing a battery pouch with drawstring.
Figure 6:
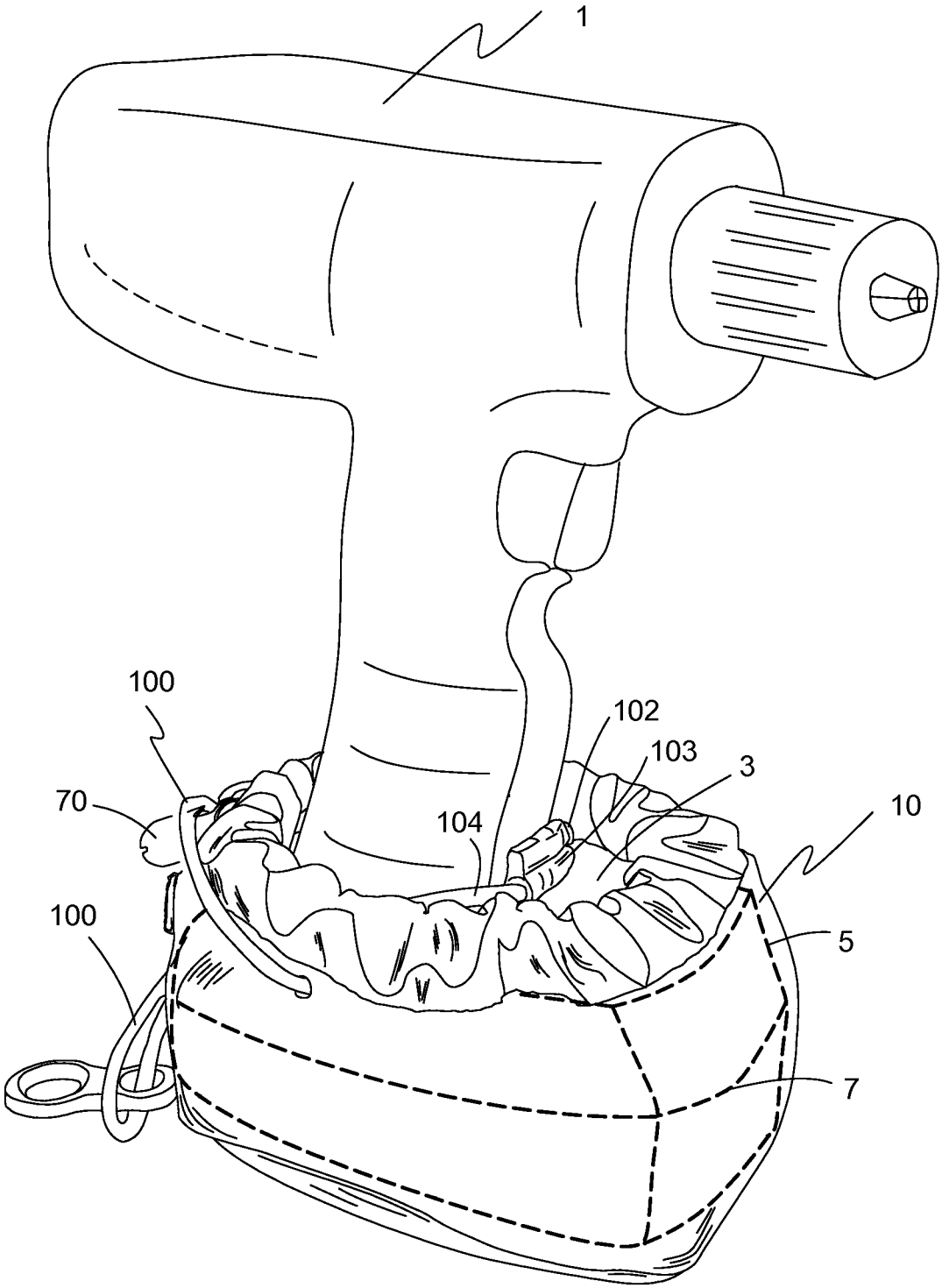
FIG. 6 is a front, top, and right-side illustration of the battery pouch of FIG. 4 installed on a cordless power tool.
Figure 7:
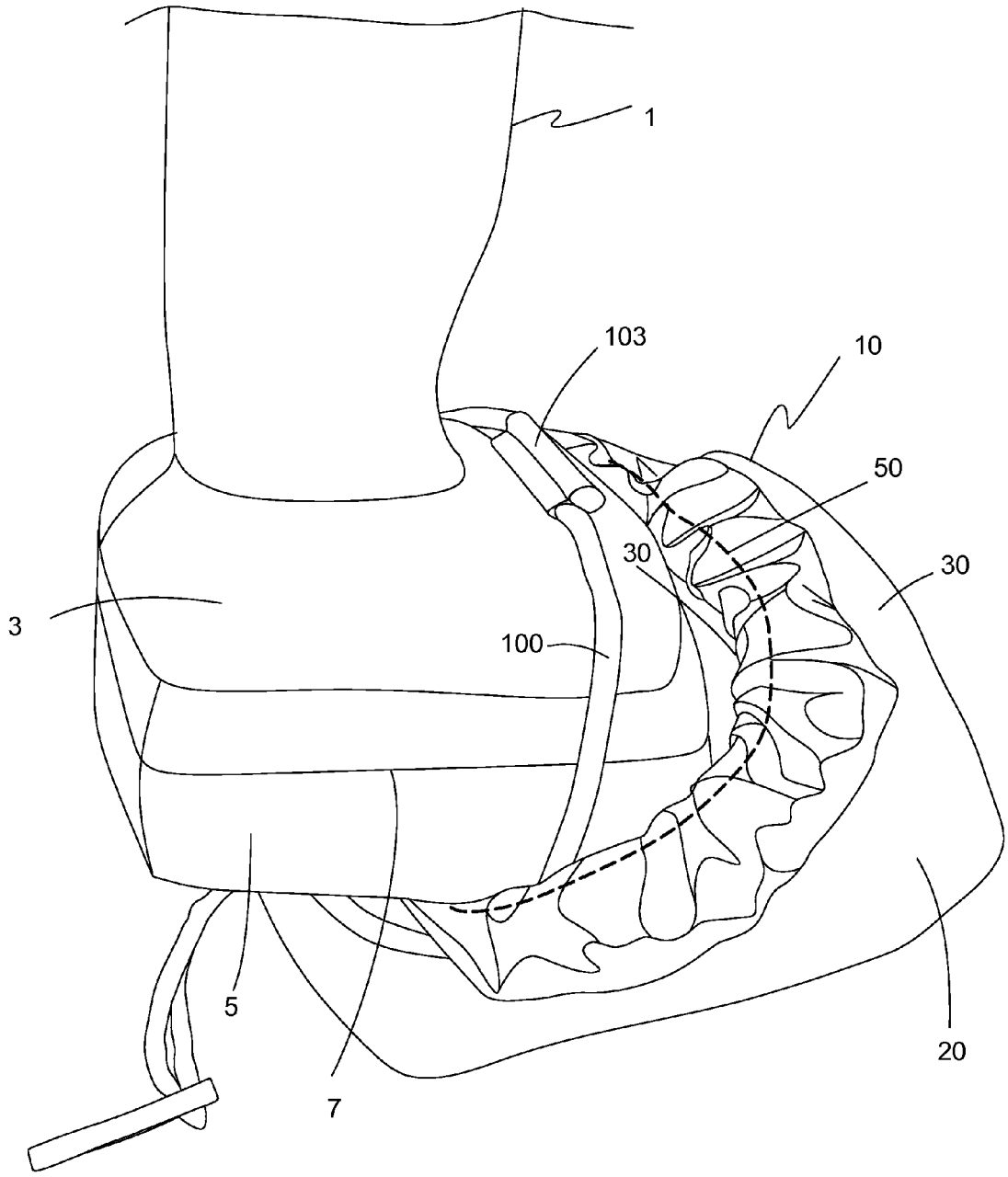
FIG. 7 is a rear, top, and left-side illustration of the battery pouch of FIG. 4 shown during installation on the cordless power tool.

FIG. 1 illustrates a side, top, and rear perspective view of one embodiment of a battery pouch 10 for use with a cordless power tool 1 with a removable battery pack 5 (shown, for example, in FIG. 7). Battery pouch 10 is a drop-prevention device that includes a pouch body 20 having a bottom portion or floor 22 and a sidewall 24 extending transversely (e.g. upwardly) from floor 22. Pouch body 20 defines a chamber 15 sized to receive battery pack 5 of cordless power tool 1 (shown in FIGS. 3-7 and 12). In one embodiment, battery pouch 20 snugly receives battery pack 5. Battery pouch 10 as shown in FIG. 1 also includes a drawstring 50 extending through an optional cord lock 70, and an optional cord lock retaining strap 90. An optional tether connector 120 is attached to drawstring 50. Optionally, pouch body 20 defines at least one drain aperture 23 in sidewall 24 and/or floor 22.

Sidewall 24 defines a sidewall perimeter 26 with a circumferential length at least as great as a circumferential length of the corresponding battery pack perimeter 7 (shown in FIG. 6). In one embodiment, sidewall 24 has the general shape of a rectangle or circle as viewed from above, but other general shapes are acceptable provided that battery pouch 20 can receive and retain battery pack 5. Sidewall 24 has a rim or top sidewall portion 28 that defines a mouth or pouch opening 30 with a pouch opening perimeter 32. Bottom end 22 and sidewall 24 are preferably made of a flexible material, such as canvas, nylon, cotton, or other textiles. Various nylon, cotton, and polyester fabrics and fabric blends sold under the mark Cordura®, and variations thereof, are examples of acceptable materials. In one embodiment, top sidewall portion 28 of sidewall 24 is elasticized along at least a portion thereof. In one embodiment, top sidewall portion 28 includes a length of elastic material fixed thereto. In another embodiment, top sidewall portion 28 includes or forms a conduit 40 that extends partially or completely around pouch opening 30. In one embodiment, the conduit 40 is made of a flexible material that permits bunching when conduit 40 is constricted by a drawstring 50 extending through conduit 40. For example, top sidewall portion 28 is made of nylon, polyester, nylon-polyester blends, cotton, canvas, or other suitable materials.

In one embodiment, conduit 40 is a closed or mostly closed along its path. In one embodiment, conduit 40 is formed by doubling over top sidewall portion 28 (or sections thereof) and securing it to itself, such as by stitching, adhesive, or other means. In one embodiment as shown in FIG. 1, conduit 40 is continuous and has a single conduit opening 42 at or near rear portion 28*d* through which drawstring 50 passes.

Figure 2:
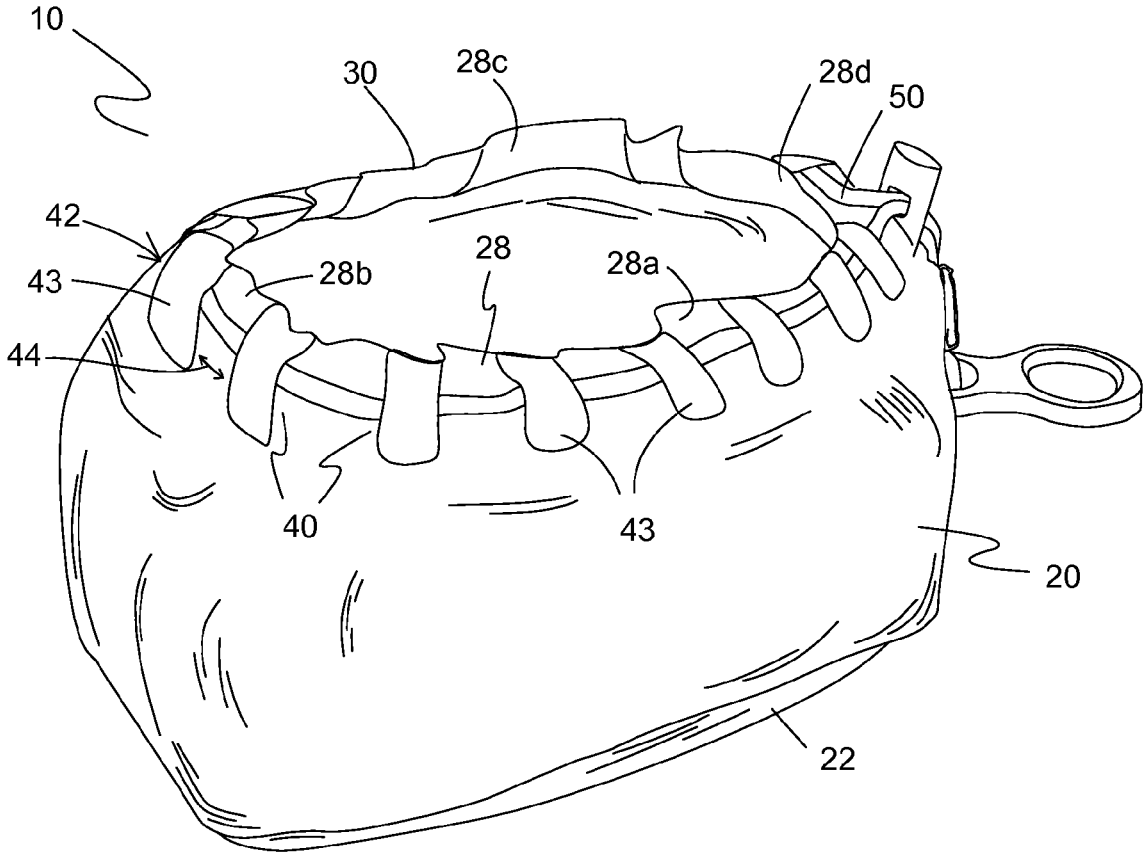
FIG. 2 is front, top, and left-side perspective illustration of another embodiment of the present invention showing a conduit with a plurality of conduit segments.

Referring now to FIG. 2, another embodiment of battery pouch 10 is shown in a front, top, and side perspective view. In this embodiment, conduit 40 is defined by a plurality of conduit segments 43. Conduit segments 43 may be made of flexible or rigid materials, such as fabric loops or metal eyelets attached to top sidewall portion 28. A conduit segment 43 may be formed by doubling over top sidewall portion 28 as discussed above. Conduit segments 43 may also be formed by cord guides, eyelets, fabric straps or loops, or the like that are fixedly attached to top sidewall portion 28. For example, a plurality of straps are secured to pouch body 20 and extend from top sidewall portion 28 at or near pouch opening 30 to a second predefined position on sidewall 24. In another embodiment, fabric straps loop over top sidewall portion 28. Where conduit segments 43 are formed by straps, conduit segments 43 are analogous to belt loops along the waist of a pair of pants. Optionally, each conduit segment 43 may be defined by a part of top sidewall portion 28 along a side or sides of pouch body 20.

For example, a conduit segment 42 is defined along part or all of each of first side portion 28*a*, front portion 28*b*, second side portion 28*c*, and rear portion 28*d*, where conduit 40 comprises a plurality of conduit segments 43. Thus, conduit 40 can be continuous or segmented, where drawstring 50 passing therethrough may or may not be enclosed along the entire path of conduit 40.

In another embodiment, conduit 40 comprises a plurality of discrete conduit segments 43 that may be separated by a gap or conduit opening 44. Drawstring 50 passing though such an embodiment of conduit 40 would be exposed at each conduit opening 42 between conduit segments 43. In one embodiment, gaps 42 between conduit segments 43 expand in size when pouch opening 30 is converted from a restricted position to a less-restricted or a fully-open position. Accordingly, when drawstring 50 constricts pouch opening 30 to a smaller size, drawstring 50 may become partly or fully concealed by conduit segments 43 as they become increasingly closely drawn together by drawstring 50.

Referring again to FIG. 1, drawstring 50 has a first drawstring end 52 and a second drawstring end 54. Drawstring 50 extends through conduit 40 and preferably defines a closed loop with first drawstring end 52 secured or attached to second drawstring end 54. Drawstring ends 52, 54 may be attached or secured to one another, for example, by tying them together in a knot, stitching them together, fusing them together, using a union connector or crimp, or other means. In one embodiment, drawstring 50 is stretchable, such as a drawstring made of or containing elastic. In other embodiments, drawstring is not stretchable or is minimally stretchable and is made of cotton, nylon, leather, metal cable, plastic, chain, or other suitable materials. When drawstring 50 is stretchable, drawstring 50 in a resting state has a drawstring length that causes top sidewall portion 28 to bunch together so that pouch opening perimeter 32 is smaller than a circumferential length of battery pack perimeter 7 (shown in FIG. 6) and also smaller than a circumferential length of sidewall perimeter 26, thereby preventing the battery pack 5 from separating and/or dropping away from cordless power tool 1 even when battery pack 5 is inadvertently decoupled from cordless power tool 1. When drawstring 50 is in a stretched (when the drawstring is made of a stretchable material) or loosened (when the drawstring is made of a non-stretchable material) state, pouch opening perimeter 32 can have a circumferential length that is as great as a circumferential length of sidewall perimeter 26, thereby permitting battery pack 5 to be installed into and removed from pouch body 20.

When drawstring 50 defines a closed loop, an outside portion 56 of drawstring 50 optionally extends outside of conduit 40 through a conduit opening 44. Outside portion 56 then optionally passes through cord lock 70 installed on outside portion 56 positioned outside of conduit 40. Cord lock 70 has a first cord lock side or side portion 72 that faces or is positioned towards conduit opening 44. Cord lock 70 has a second cord lock side or side portion 74 opposite of first cord lock side 72 that faces away from conduit opening 44. Cord lock 70 releasably and temporarily fixes the path length of drawstring 50 around pouch opening 30 and therefore temporarily fixes pouch opening perimeter 32 to a predefined opening size.

In some embodiments, pouch body 20 has a cord lock retaining strap 90 attached at end portions 90*a*, 90*b* to outside surface 20*a* of pouch body 20, preferably on sidewall 24, defining a cord lock strap pathway 93 between cord lock retaining strap 90 and outside surface 20*a*. Cord lock retaining strap 90 is attached by stitching, rivets, fasteners, or other fastening or attachment means. In one embodiment, outside portion 56 of drawstring 50 passes through pathway 93 with optional cord lock 70 positioned between cord lock retaining strap 90 and conduit opening 44. In this configuration, when outside portion 56 of drawstring 50 extends through cord lock retaining strap 90, and tether connector 120 at end 56*a* of outside portion 56 is pulled away from pouch body 20 (as occurs when cordless power tool 1 is dropped), cord lock 70 is restricted from passing through passageway 93, thereby causing drawstring 50 to further cinch pouch opening 30 with cord lock 70 being held towards conduit opening 44. Thus, restraining strap 90 functions to maintain cord lock 70 close to conduit opening 44 and slide along drawstring 50 as drawstring 50 tightens, thereby causing drawstring 50 to further constrict pouch opening perimeter 32 to have a path length that is smaller than that of battery pack perimeter 7. This action is similar to how drawstring 50 would be manually tightened by a person using one hand to pull outside portion 56 of drawstring 50 away from pouch body 20 and another hand to maintain or push cord lock 70 close to conduit opening 44.

In some embodiments, drawstring 50 is stretchable and defines a closed loop that extends through conduit 40 only along pouch opening 30, where drawstring 50 is partially or completely enclosed within conduit 40. That is, drawstring 50 lacks outside portion 56. When drawstring 50 does not define a closed loop, outside portion 56, extends from conduit opening 44 so that it may be secured by the user in order to maintain pouch opening 30 in a constricted state as needed to retain battery pack 5 coupled with cordless power tool 1. In other embodiments, rather than being secured to one another to form a closed loop, one or both of drawstring end(s) 52, 54 are secured to pouch body 20 after exiting conduit 40. For example, one or both drawstring ends 52, 54 is secured to pouch body 20. In another example, drawstring ends 52, 54 extend from conduit opening(s) 44 and are each knotted as a way to fix the size of pouch opening 30.

Figure 3:
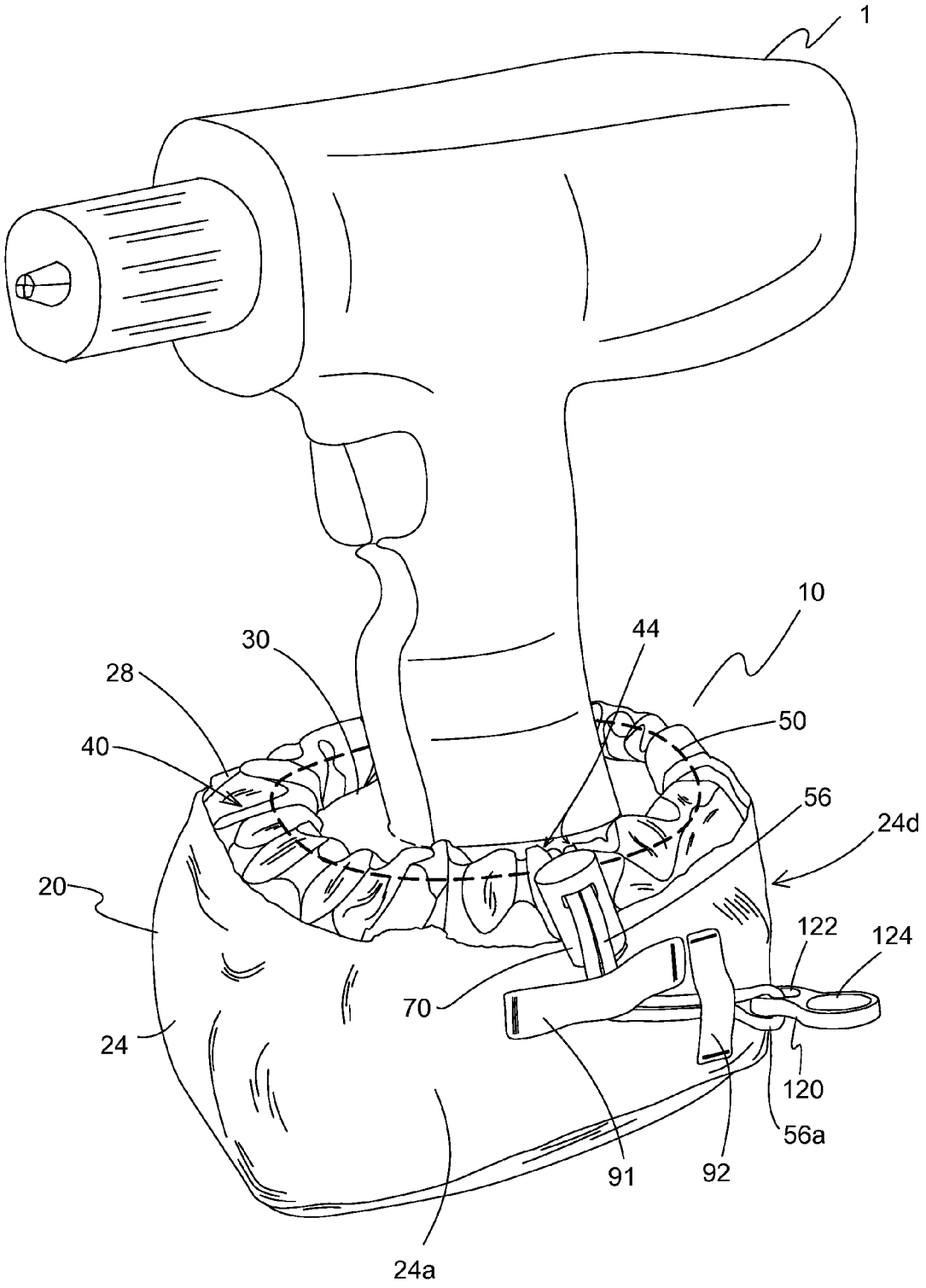
FIG. 3 is a front, top, and left-side perspective illustration of another embodiment of the present invention showing a battery pouch installed on a cordless power tool with first and second cord lock retaining straps.

Turning now to FIG. 3, a side, front, and top perspective view illustrates another embodiment of battery pouch 10 installed over battery pack 5 (not shown) of cordless power tool 1. Drawstring 50 extends through conduit 40 formed by top sidewall portion 28. Drawstring 50 is pulled tight to constrict pouch opening 30 with conduit 40 and top sidewall portion 28 being bunched together. Outside portion 56 of drawstring 50 exits conduit 40 through conduit opening 44 and then passes through cord lock 70, which is capable of maintaining pouch opening 30 in a constricted position. After passing through cord lock 70, outside portion 56 of drawstring 50 passes through a first cord lock retaining strap 91, then through a second cord lock retaining strap 92 oriented transversely to first cord lock retaining strap 91. In one embodiment, first cord lock retaining strap 91 is positioned substantially horizontally and attaches to sidewall 24 adjacent top sidewall portion 28. Second cord lock retaining strap 92 is positioned substantially vertically and attaches to sidewall 24 adjacent first cord lock retaining strap 91. Here, the terms horizontal and vertical refer to orientations when bottom 22 is resting on a level, horizontal surface. Thus, outside portion 56 of drawstring 50 is directed towards rear portion 24*d* so that it is out of the way of the user. To achieve a similar result, another embodiment of battery pouch 10 has a single cord lock retaining strap 90, eyelet, cord guide, or the like attached to sidewall 24 at an angle of about 45° along sidewall 24.

Drawstring 50 is optionally connected to tether connector 120 at end 56*a*. In one embodiment, drawstring 50 passes through a first opening 122 of tether connector 120. Tether connector 120 optionally has a second opening 124 for making a separate connection to a tether or lanyard (not shown). Because each of first and second cord lock retaining straps 91, 92 are attached to sidewall 24 with minimal slack, they are configured to be substantially flat against sidewall 24 so as to restrict cord lock 70 from passing between each of retaining straps 91, 92 and sidewall 24 when battery pouch 10 is installed on battery pack 5. Tether connector 120 is similarly restricted from passing through first and second cord lock retaining straps 91, 92, but, due to having a flatter shape, tether connector 120 may be positioned flat against sidewall 24 for passage through retaining straps 91, 92 and is therefore not restricted to the extent that cord lock 70 is restricted. Depending on the length of first and second cord lock retaining straps 91, 92, when battery pouch 10 is removed from battery pack 5, pouch body 20 may be manipulated to provide sufficient space between sidewall 24 and retaining straps 91, 92 so that cord lock 70 and/or tether connector 120 can be passed through one or both of retaining straps 91, 92.

Turning now to FIGS. 4 through 11, another embodiment of battery pouch 10 is shown that includes a pouch body 20 with a sidewall 24 and top sidewall portion 28, drawstring 50 (shown as a broken line) extending through conduit 40 around pouch opening 30, and a retaining cord 100 extending through sidewall 24 and over foot 3 of cordless power tool 1.

Figure 4:
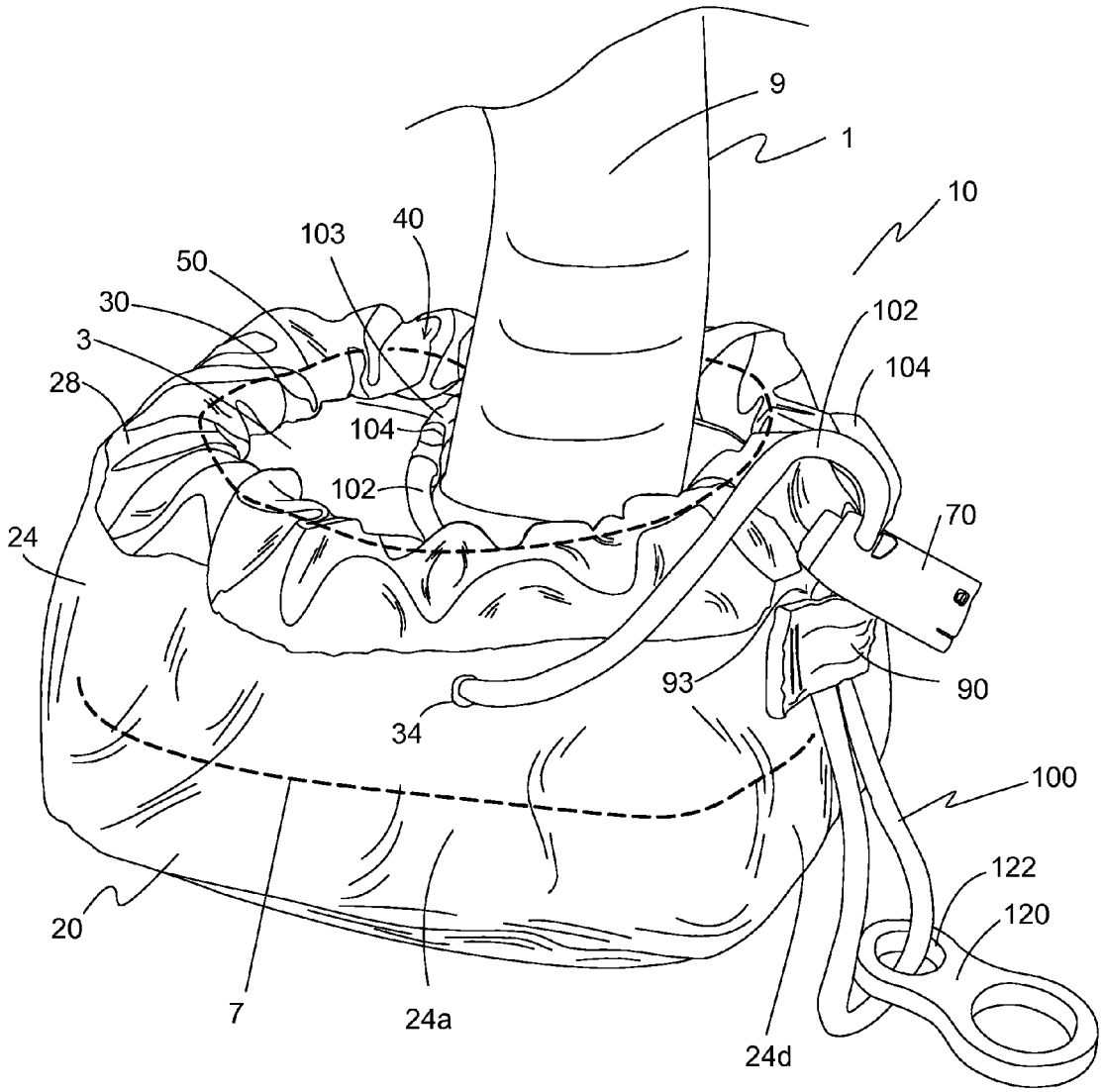
FIG. 4 is a rear, top, and left-side perspective illustration of another embodiment of the present invention showing a battery pouch installed on a cordless power tool with an elasticized opening and a retaining cord.

FIG. 4 shows a left side, top, and rear perspective view of battery pouch 10 installed on cordless power tool 1. Top sidewall portion 28 defines conduit 40 along pouch opening 30. Drawstring 50 is stretchable and forms a closed loop that extends through conduit 40. Except where drawstring 42 may be visible as it extends across any optional conduit opening 44 (not visible; shown in FIG. 3), drawstring 50 is concealed within conduit 40. Because drawstring 50 is stretchable, in its resting state drawstring 50 constricts pouch opening 30 so that pouch opening perimeter 32 has a path length that is shorter than the path length of battery pack perimeter 7 (represented by a dashed line 7 in FIG. 4).

A retaining cord 100 has first and second retaining cord portions 102, 104 connected together to define a closed loop, which is more clearly shown in FIG. 7. First retaining cord portion 102 passes into pouch body 20 through first opening 34 in first side portion 24*a* of sidewall 24. Second retaining cord portion 104 passes into pouch body 20 through second opening 36 (shown in FIG. 8) in second side portion 24*c* of sidewall 24. Retaining cord 100 defines a foot portion 103 that passes over and across foot 3 of cordless power tool 1 near where foot 3 meets a handle 9 of power tool 1. Retaining cord 100 is visible generally within pouch opening 30 where foot portion 103 passes over foot 3 of power tool 1. From foot portion 103, second retaining cord portion 104 exits pouch body 20 through second opening 36 (not visible; shown in FIG. 5) in second side portion 24*c* of sidewall 24 before extending past handle 9. First side portion 24*a* and second side portion 24*c* of sidewall 24 preferably are opposite lateral faces of pouch body 20. First and second openings 34, 36 are preferably located adjacent top sidewall portion 28. Second drawstring 104 portion meets first retaining cord portion 102 adjacent rear portion 24*d* of sidewall 24, where first and second retaining cord portions 102, 104 extend through cord lock 70, then through passageway 93 of cord lock retaining strap 90, and finally loop through first opening 122 of tether connector 120. In some embodiments, retaining cord 100 passes through a single opening in pouch, such as through an opening formed by a grommet installed in rear portion 24*d* of sidewall 24.

Figure 5:
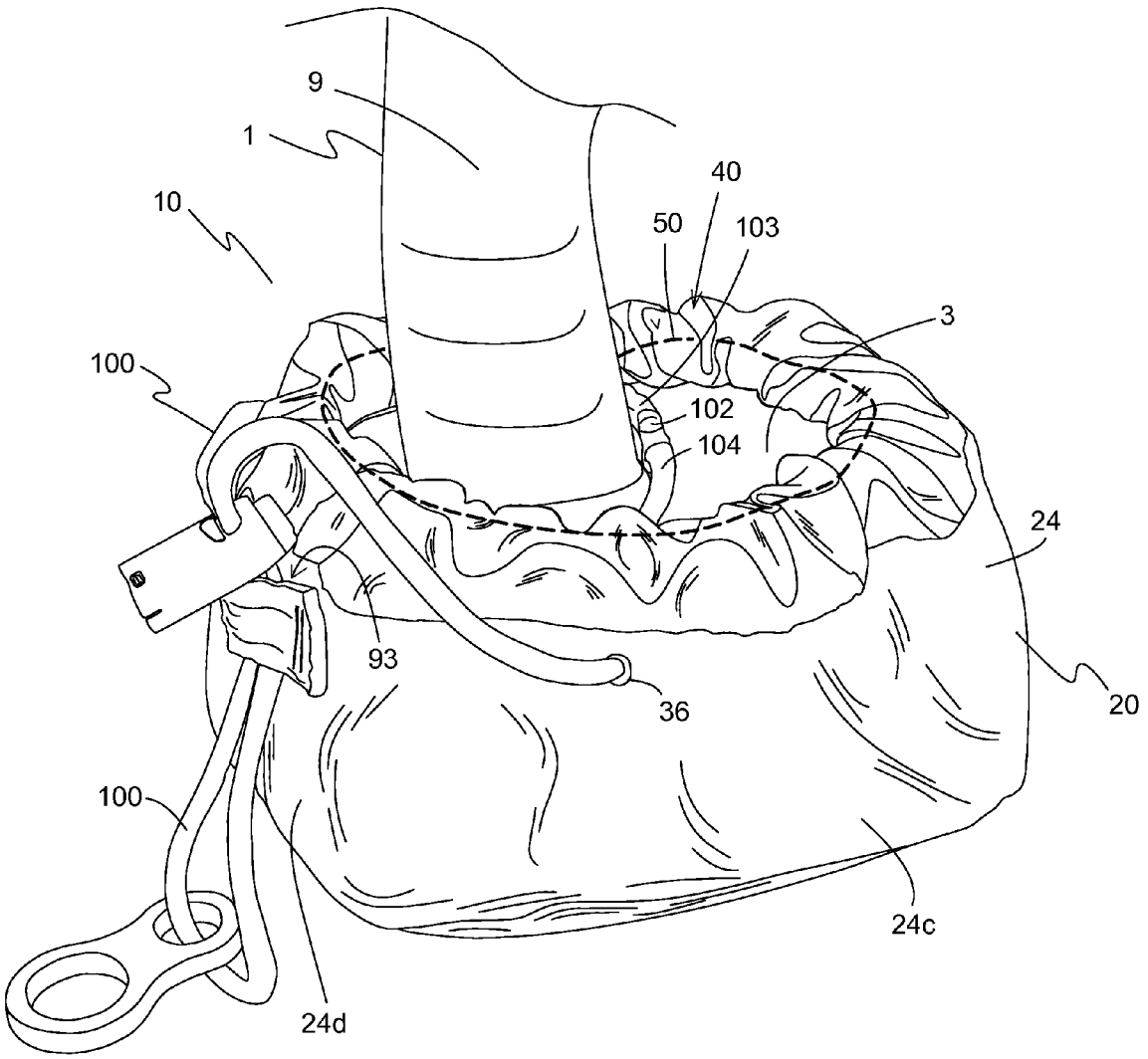
FIG. 5 is a rear, top, and right-side illustration of the battery pouch of FIG. 4.

FIG. 5 shows a right side, top, and rear perspective view of battery pouch 10 installed on cordless power tool 1. Retaining cord 100 passes into pouch body 20 through second opening 36 of second side portion 24*c*, and then is fixed to first retaining cord portion 102 to define foot portion 103 that passes over foot 3.

In FIGS. 4 through 6, retaining cord 100 is shown at least somewhat tightened against foot 3 so that battery pouch 10 retains battery pack 5 (not visible) with cordless power tool 1 and so that battery pouch 10 remains reliably installed on cordless power tool 1. For installation or removal of battery pouch 10, cord lock 70 would be released to loosen retaining cord 100 and provide sufficient slack to permit passage of foot 3 and battery pack 7 through foot portion 103 of retaining cord 100.

Turning now to FIG. 6, a right side, top, and front perspective view shows battery pouch 10 installed over battery pack 5 of cordless power tool 1. Elasticized top sidewall portion 28 provides a constricted pouch opening 30 over foot 3. First and second retaining cord portions 102, 104 of retaining cord 100 define foot portion 103 that extends over foot 3 and through sidewall 24, joining together at cord lock 70. Retaining cord 100 is at least somewhat tightened so that battery pouch 10 is retained on battery pack 5 (shown in broken lines).

Turning now to FIG. 7, a left side, top, and rear perspective view shows battery pouch 10 in the process of being installed over battery pack 5 of cordless power tool 1. Retaining cord 100 is loosened sufficiently so that foot 3 with battery pack 5 pass through the closed loop of retaining cord 100 with foot portion 103 passing across foot 3. To complete installation, elasticized pouch opening 30 is stretched so that pouch body 20 receives battery pack 5 and foot 3 through pouch opening 30. Battery pack 5 is inserted through pouch opening 30 in its expanded state and is received in battery pouch 10. After adjusting battery pouch 10 over battery pack 5, elasticized pouch opening 30 (e.g., drawstring 50) will resume its resting position to the extent possible, thereby constricting pouch opening 30 and retaining battery pouch 10 over battery pack 5. Retaining cord 100 is then cinched tight against cordless power tool 1 to further insure that battery pouch 10 is not inadvertently removed from cordless power tool 1.

Figure 8:
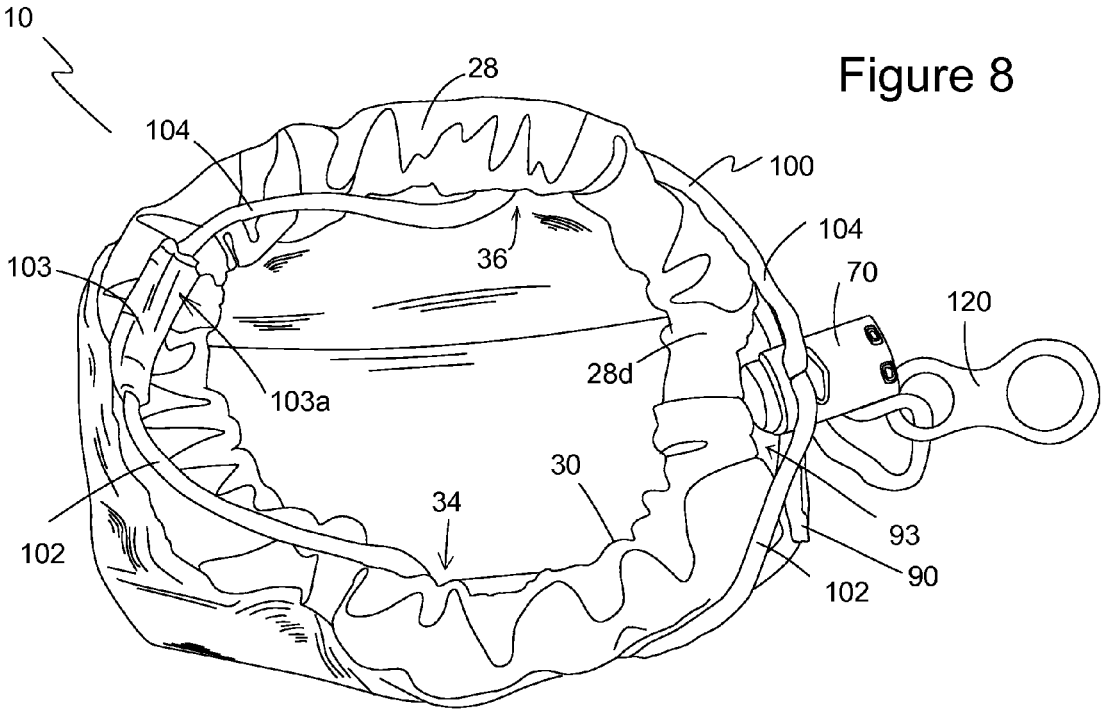
FIG. 8 is a top plan view of the battery pouch of FIG. 4.

Turning now to FIG. 8, a top view is shown of one embodiment of battery pouch 10 that includes elasticized pouch opening 30 and retaining cord 100. First retaining cord portion 102 of retaining cord 100 is connected to second retaining cord portion 104 of retaining cord 100 at foot portion 103. For example, first and second retaining cord portions 102, 104 are stitched together with a fabric sleeve 103*a* for reinforcement. First retaining cord portion 102 of retaining cord 100 passes through first opening 34 (not visible) then towards rear portion 28*d* of top sidewall portion 28. Second retaining cord portion 104 of retaining cord 100 passes through second opening 36 (not visible) and then also towards rear portion 28*d* of top sidewall portion 28 where it meets first retaining cord portion 102 of retaining cord 100 and passes through cord lock 70 and passageway 93 of cord lock retaining strap 90. Tether connector 120 is attached to second drawstring 100.

Figure 9:
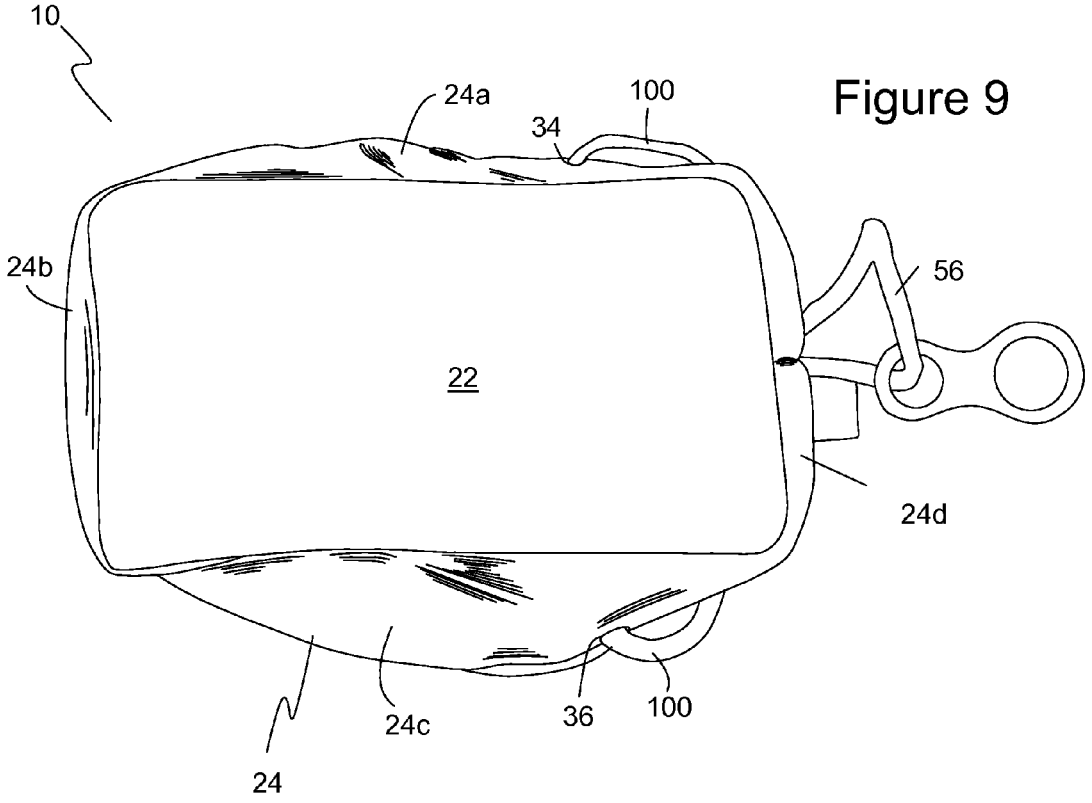
FIG. 9 is a bottom plan view of the battery pouch of FIG. 4.

Turning now to FIG. 9, a bottom view is shown of the embodiment of battery pouch 10 of FIG. 8. Bottom portion 22 is generally rectangular and sized to fit over and around a rectangular battery pack 5 (shown in FIG. 7). First side portion 24*a*, front portion 24*b*, second side portion 24*c*, and rear portion 24*d* of sidewall 24 extend from bottom portion 22. Second drawstring 10 extends through first and second openings 34, 36 of sidewall 24.

Figure 10:
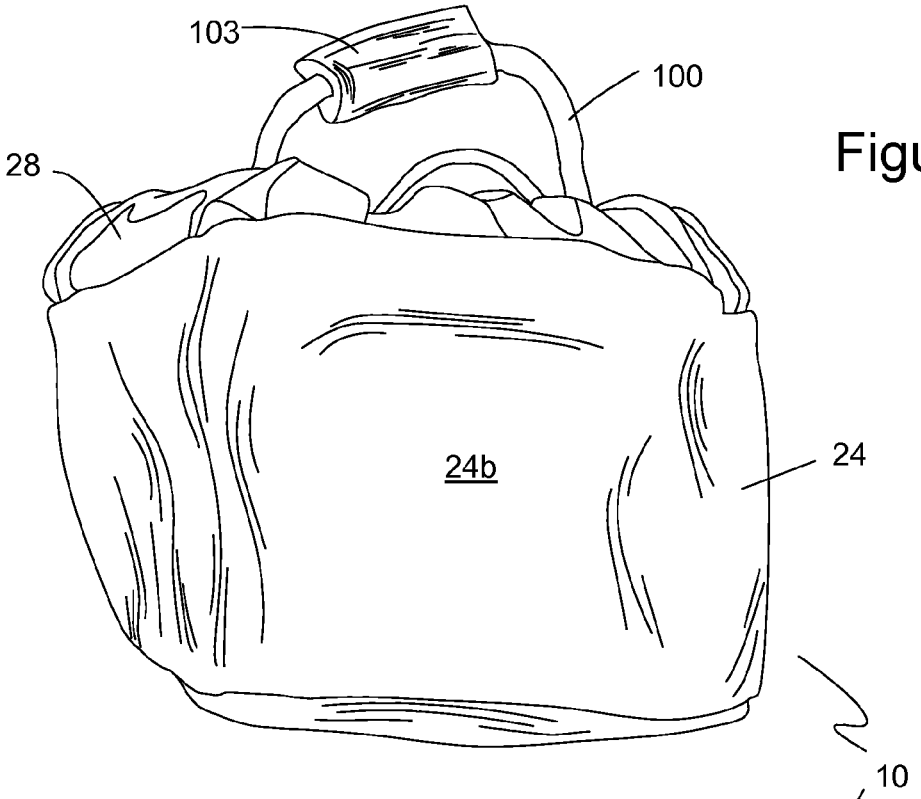
FIG. 10 is front elevational view of the battery pouch of FIG. 4.

Turning now to FIG. 10, the embodiment of battery pouch 10 of FIG. 8 is shown looking at front portion 24*a* of sidewall portion 24. Foot portion 103 of retaining cord 100 extend from pouch opening 30 (not visible) defined by top sidewall portion 28.

Figure 11:
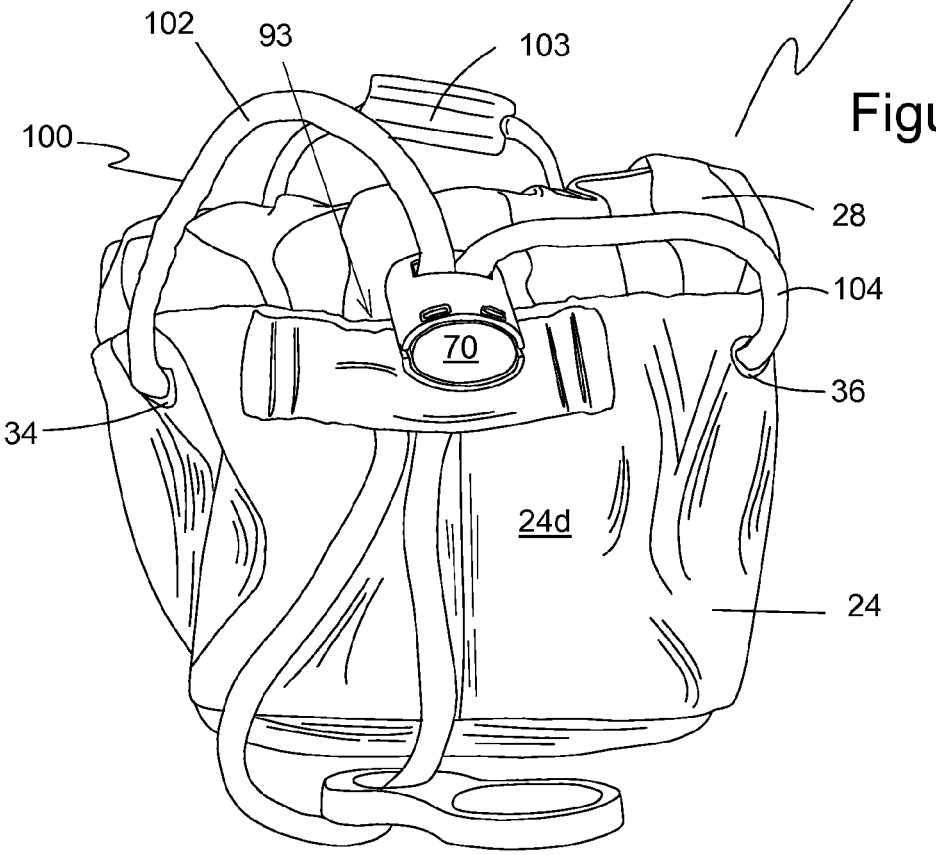
FIG. 11 is a rear elevational view of the battery pouch of FIG. 4.

Turning now to FIG. 11, the embodiment of battery pouch 10 of FIG. 8 is shown as looking at rear portion 24*d* of sidewall portion 24. First and second retaining cord portions 102, 104 of retaining cord 100 extends from first and second openings 34, 36, respectively, extend through cord lock 70, and then through passageway 93 of cord lock retaining strap 90. Foot portion 103 extends up through pouch opening 30 (not visible) defined by top sidewall portion 28.

Figure 12:
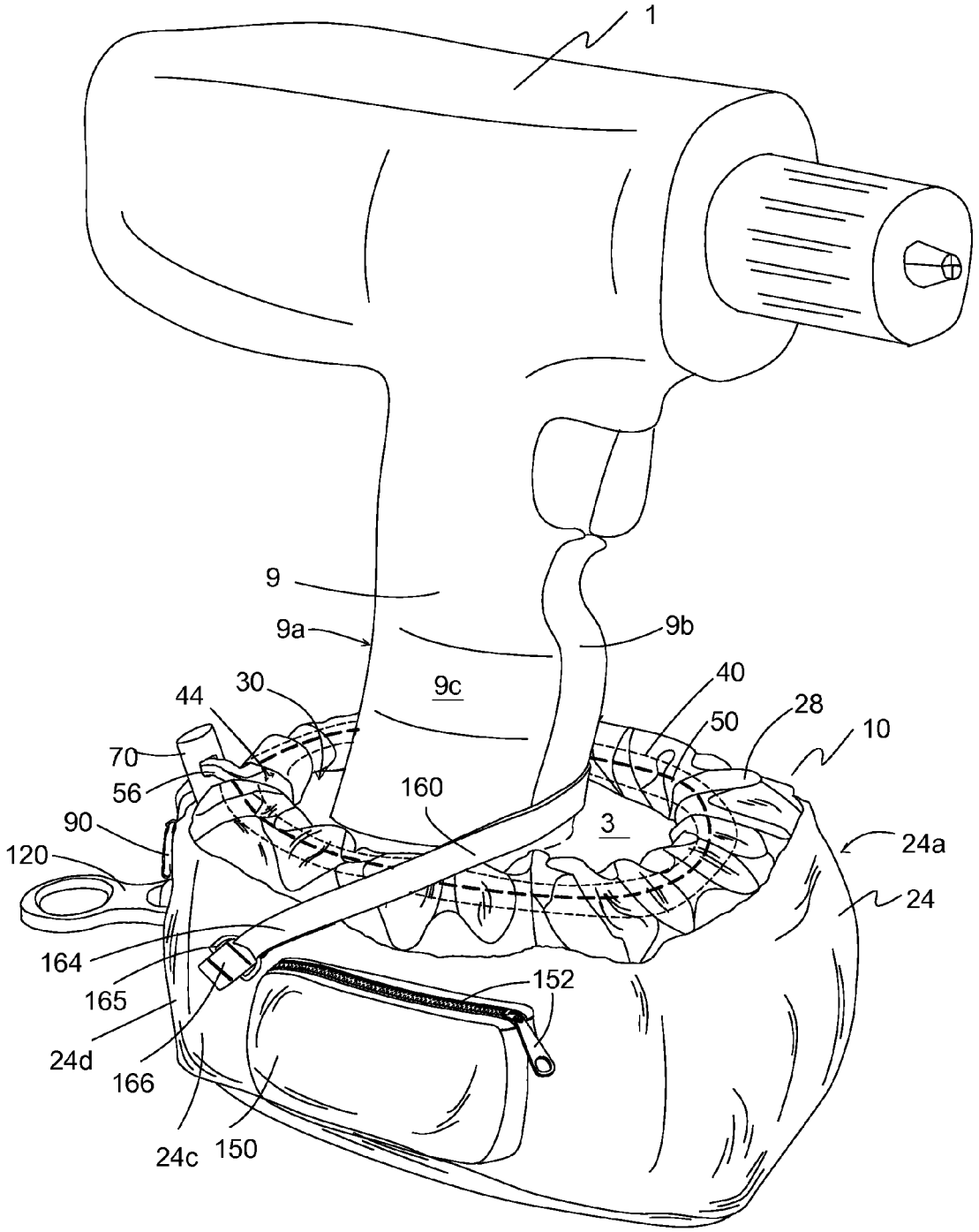
FIG. 12 is a front, top, and right-side perspective illustration of another embodiment of the present invention showing a battery pouch installed on a cordless power tool with a retaining strap.
Figure 13:
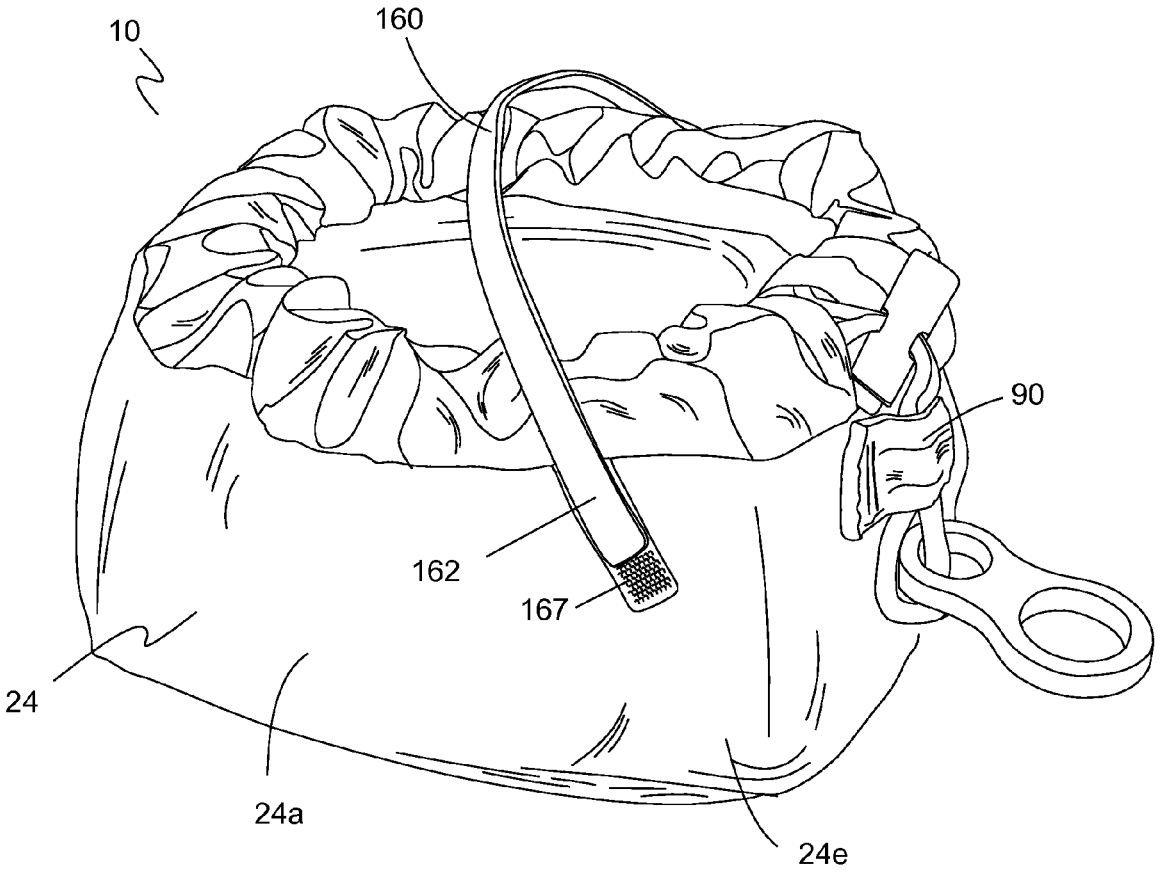
FIG. 13 is a rear, top, and left-side perspective illustration of the battery pouch of FIG. 12.

Turning now to FIGS. 12 and 13, another embodiment of battery pouch 10 is shown that includes a pouch retaining strap 160. In FIG. 12, battery pouch 10 is installed on a cordless power tool 1. Similar to the embodiment shown in FIG. 1, drawstring 50 extends through conduit 40 around pouch opening 30. Outside portion 56 of drawstring 50 exits conduit 40 through conduit opening 44, passes through cord lock 70, passes through passageway 93 (not visible) of cord lock retaining strap 90, and loops through tether connector 120. Optionally, drawstring 50 is stretchable to provide an elasticized pouch opening 30.

An optional pocket 150 is attached to sidewall 24 and is useful for storing accessories, fasteners, and the like. Pocket 150 is attached to first side portion 24*a* or second side portion 24*c*, but other locations on battery pouch 10 are acceptable. Pocket 150 has a closure 152 to selectively close and open pocket 150. Closure in one embodiment is a zipper, but could alternately be a snap, button, hook-and-loop fastener, or other suitable device.

Battery pouch 10 also includes an optional pouch retaining strap 160 connected between first side portion 24*a* and second side portion 24*c* of sidewall 24. To maintain battery pack 5 towards rear portion 24*d* of sidewall 24, first and second pouch retaining strap ends 162, 164, attach to sidewall 24 rearwadly of handle 9. Pouch retaining strap 160 extends over foot 3 or around forward side 9*b* of handle 9 of cordless power tool 1. Pouch retaining strap 160 has second pouch retaining strap end 164 attached to second side portion 24*c* of sidewall 24 near a rear side portion 24*d* of battery pouch 10. In one embodiment, second pouch retaining strap end 164 attaches to sidewall 24 by passing through a D-ring 165 that is connected by a D-ring strap 166 secured to sidewall 24. Other attachment means are also acceptable, including stitching, a snap, a button, or the like.

Turning now to FIG. 13, battery pouch 10 of FIG. 12 is shown in a left side, rear, and top perspective view. First pouch retaining strap end 162 of pouch retaining strap 160 is releasably attached to first sidewall portion 24*a* of sidewall 24, preferably on heel portion 24*e* of first sidewall portion 24*a*. In one embodiment, second pouch retaining strap end 162 attaches to sidewall 24 with fastener 167, such as a hook-and-loop fastener. Other attachment devices are also acceptable, such as a snap, button, buckle, tying first pouch retaining strap end 162 to a connector, and the like. In other embodiments, pouch retaining strap 160 comprises two overlapping portions that fasten together across foot 3 using, for example, a hook-and-loop fastener, a button, a snap, a buckle, or other device.

Referring now to FIG. 14, a flow chart illustrates steps in one embodiment of a method 500 of tethering a battery-powered power tool. In step 505, the user provides a battery pouch 10 defining a chamber 15 sized to receive the battery back of a cordless power tool. The battery pouch 10 has pouch opening 30 that is convertible between a smaller opening size and a larger opening size. In one embodiment, step 505 includes selecting a battery pouch 10 that includes a flexible conduit 40 with drawstring 50 extending through the conduit. In another embodiment, step 505 includes selecting battery pouch 10 so that drawstring 50 is elasticized or stretchable. In another embodiment, step 505 includes selecting battery pouch 10 where pouch opening 30 is elasticized and retaining cord 100 extends through one or more openings in sidewall 24 and across foot 3 of cordless power tool 1.

In step 510, the user converts pouch opening 30 to the larger opening size as needed to slip pouch body 20 over battery pack 5 and foot 3. For example, step 510 is performed by stretching elastic or a stretchable drawstring 50 that extends along top sidewall portion 28. In another embodiment, the user releases slack on drawstring 50 extending through conduit 40 so that pouch opening 30 can be expanded to receive battery pack 5 therethrough.

In step 515, battery pouch 10 is installed on cordless power tool 1. Battery pouch 10 is adjusted so that battery pack 5 is seated in chamber 15, with bottom 22 and sidewall 24 of pouch body 20 adjacent battery pack 5.

In step 520, pouch opening 30 is converted to the smaller size. For example, drawstring 50 is tightened as needed to constrict pouch opening 30 and to constrain pouch opening perimeter 32 to have a path length that is smaller than that of battery pack perimeter 7. Preferably, battery pouch 10 has a snug fit with battery pack 5. Drawstring 50 is optionally maintained in a constricted state with cord lock 70 installed on drawstring 50. When drawstring 50 is stretchable, drawstring 50 may automatically return after installation as much as possible to a resting state in which pouch opening 30 is constricted to maintain battery pouch 10 on cordless power tool 1 and to retain battery pack 5 attached to foot 3 of cordless power tool 1.

In step 525, foot portion 103 of retaining cord 100 is looped over foot 3 of cordless power tool 1. First and second retaining cord portions 102, 104 are extended through openings 34, 36 in sidewall 34 and extended towards rear portion 24*d* of sidewall 24. First and second retaining cord portions 102, 104 then extend through cord lock 70 and through passageway 93 of cord lock retaining strap 90. Cord lock 70 is positioned between cord lock retaining strap 90 and pouch opening 30. For example, cord lock 70 is positioned on the entrance side of cord lock retaining strap 90 where retaining cord 100 enters passageway 93, rather than on the exit side towards tether connector 120. When drawstring 50 extends from conduit 40, it preferably passes through cord lock 70, then through retaining strap(s) 90, and then loops through optional tether connector 120.

In step 530, retaining cord 100 is tightened against foot 3 or handle 9 of cordless power tool 1. Cord lock 90 is useful for maintaining tension on retaining cord 100 after tightening.

When battery pouch 10 has retaining cord 100, battery pouch 10 is installed so that retaining cord 100 defines a foot portion 103 that passes over foot 3 and around front side 9*b* of handle 9 of cordless power tool 1. Similarly, when battery pouch 10 has pouch retaining strap 160, pouch retaining strap 160 is attached between first side portion 24*a* and second side portion 24*c* of sidewall 24 with pouch retaining strap 160 extending across foot 3 adjacent front side 9*b* of handle 9.

In step 535, drawstring 50 or retaining cord 100 is connected to a tether.

With battery pouch 10 installed, battery pack 5 is prevented from inadvertently becoming knocked loose from foot 3 and falling. By optionally connecting one end of a tether to tether connector 120, battery pouch 10 also functions to arrest a drop of cordless power tool 1 as a whole. In such a case, force applied to drawstring 50 in a direction away from cordless power tool 1, such as experienced after dropping cordless power tool 1, causes drawstring 50 to further constrict pouch opening 30 with cord lock 70 preventing drawstring 50 from returning to a less-constricted state and being held in position by cord lock retaining strap 90. Thus, battery pouch 10 arrests a drop of cordless power tool 1 as a whole and of battery pack 5 individually. For added assurance, retaining cord 100 or pouch retaining strap 160 secure battery pouch 10 on cordless power tool 1 so that even in exceptional cases, battery pouch 10 is prevented from being forcibly removed from cordless power tool 1. Drain aperture 23 is an opening in pouch body 20 that permits moisture or liquids to drain.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A method of tethering a power tool having a battery pack comprising:

providing a battery pack pouch that defines a compartment sized to receive the battery back of a cordless power tool, the battery pack pouch having a pouch opening convertible between a smaller opening size and a larger opening size, and having a retaining cord with a first portion extending through a flexible conduit attached along the pouch opening and with a second portion extending out of the flexible conduit;

converting the pouch opening to the larger opening size;

installing the battery pack pouch over the battery pack of the cordless power tool with a portion of the cordless power tool extending through the pouch opening;

converting the pouch opening to the smaller opening size, thereby retaining the battery pack in the compartment;

extending the retaining cord in a closed loop around the portion of the cordless power tool extending through the pouch opening;

tightening the retaining cord against the portion of the cordless power tool extending through the pouch opening; and connecting the second portion of the retaining cord to a tether;

wherein the retaining cord is configured to tighten around the tool and retain the pouch with the tool when the retaining cord is subjected to a pulling force, thereby preventing the battery pack from decoupling from the cordless power tool.

2. The method of claim 1, wherein the flexible conduit extends along a major portion of the pouch opening.

3. The method of claim 1, wherein the providing step further includes selecting the battery pack pouch wherein the retaining cord is elasticized.

4. The method of claim 1, wherein the providing step includes selecting the battery pack pouch with the retaining cord extending through a first sidewall opening and through a second sidewall opening in a sidewall of the battery pack pouch, wherein the retaining cord extends through the first sidewall opening, across the portion of the cordless power tool, and through the second sidewall opening.

5. The method of claim 1, wherein the providing step includes selecting the battery pack pouch with an elasticized pouch opening, the step of converting the pouch opening to the larger opening size includes stretching the elasticized opening, and the step of converting the pouch opening to the smaller opening size includes permitting the elasticized opening to at least partially resume a relaxed state.

6. The method of claim 1, wherein the providing step includes selecting the battery pack pouch with the conduit comprising a plurality of loops each connected to and extending from a top sidewall portion of a sidewall of the battery pack pouch.

7. The method of claim 1, wherein the providing step further comprises:

selecting the battery pack pouch to include a strap secured to an outside surface of a pouch sidewall and defining a strap passageway between the strap and the pouch sidewall; and prior to the step of connecting the second portion of the retaining cord to the tether, extending the second portion of the retaining cord through the strap passageway.

8. The method of claim 7, wherein the providing step further comprises:

selecting the battery pack pouch to include a cord lock installed on the second portion of the retaining cord between the flexible conduit and the strap.

9. The method of claim 1, wherein the providing step further comprises:

selecting the battery pack pouch to include a retaining strap extending from a first pouch sidewall and across the pouch opening to a second pouch sidewall.

* * * * *